US010875696B2

(12) United States Patent
Schütz

(10) Patent No.: US 10,875,696 B2
(45) Date of Patent: Dec. 29, 2020

(54) TRANSPORTING AND STORAGE CONTAINER FOR LIQUIDS

(71) Applicant: PROTECHNA S.A., Fribourg (CH)

(72) Inventor: Udo Schütz, Selters (DE)

(73) Assignee: PROTECHNA S.A., Fribourg (CH)

( * ) Notice: Subject to any disclaimer, the term of this patent is extended or adjusted under 35 U.S.C. 154(b) by 0 days.

(21) Appl. No.: 16/062,191

(22) PCT Filed: Nov. 17, 2016

(86) PCT No.: PCT/EP2016/077984
§ 371 (c)(1),
(2) Date: Jun. 14, 2018

(87) PCT Pub. No.: WO2017/108288
PCT Pub. Date: Jun. 29, 2017

(65) Prior Publication Data

US 2018/0362237 A1 Dec. 20, 2018

(30) Foreign Application Priority Data

Dec. 23, 2015 (DE) ..... 10 2015 016 814

(51) Int. Cl.
*B65D 77/04* (2006.01)

(52) U.S. Cl.
CPC ..... *B65D 77/0466* (2013.01); *B65D 2213/00* (2013.01)

(58) Field of Classification Search
CPC ..... B65D 77/0466; B65D 2213/00
USPC ..... 206/386, 600; 220/1.6, 495.01, 495.06, 220/23.87, 485
See application file for complete search history.

(56) References Cited

U.S. PATENT DOCUMENTS 5,111,937 A * 5/1992 Schutz ..... B65D 77/0466 206/386
5,358,137 A * 10/1994 Shuert ..... B65D 77/0466 206/600
5,447,250 A 9/1995 Schutz
(Continued)

FOREIGN PATENT DOCUMENTS

CN 1199702 4/1998
DE 9417426 U1 2/1995
(Continued)

*Primary Examiner* — J. Gregory Pickett
*Assistant Examiner* — Jenine Pagan
(74) *Attorney, Agent, or Firm* — King & Schickli, PLLC

(57) ABSTRACT

A transportation and storage container (20) for fluids having an inner container (22) made of plastic, an outer jacket (31) preferably realized as a lattice made of metal as well as a pallet-like base frame (24) formed for being handled by means of forklifts or similar modes of transportation, and comprising a support base (23) made of sheet metal for supporting the inner container (22) provided with at least one filling neck (45) at an upper side (47) of the inner container (22), wherein an intermediary container (21) receiving the inner container from all sides and made of sheet metal is arranged between the inner container (22) and the outer jacket, said intermediary container (21) comprising a jacket case (25), a container lid (26) connected to the jacket case (25) and a container bottom connected to the jacket case (25), the container bottom being formed by the support base (23) of the base frame (24).

12 Claims, 9 Drawing Sheets

(56) References Cited

U.S. PATENT DOCUMENTS 5,595,318 A * 1/1997 Barno ..... B65D 77/0466 220/1.5
5,680,955 A * 10/1997 Schutz ..... B65D 77/0466 220/1.5
5,704,477 A * 1/1998 Hermann ..... B65D 77/0466 206/386
5,979,685 A * 11/1999 tz ..... B65D 77/0466 220/1.6
6,010,022 A * 1/2000 Deaton ..... B65D 19/18 220/4.03
6,202,844 B1 * 3/2001 Sedlmayr ..... B65D 77/0466 206/386
6,206,228 B1 * 3/2001 Roth ..... B65D 7/34 220/1.5
2003/0024935 A1 * 2/2003 Kind ..... B65D 77/0466 220/571
2004/0164081 A1 * 8/2004 Schutz ..... B65D 77/0466 220/495.01
2014/0291356 A1 * 10/2014 Schutz ..... B65D 61/00 222/183
2016/0362223 A1 * 12/2016 Sengelin ..... B65D 19/0004
2016/0376059 A1 * 12/2016 Sengelin ..... B65D 19/0004 206/386
2018/0362237 A1 12/2018 Schutz

FOREIGN PATENT DOCUMENTS

DE 4341539 A1 6/1995
DE 19722194 A1 12/1998
DE 19920011 A1 12/2000
DE 10161693 A1 7/2003
EP 0509228 A2 10/1992
EP 0857666 A1 8/1998
EP 0879771 A1 11/1998

* cited by examiner

Fig. 4
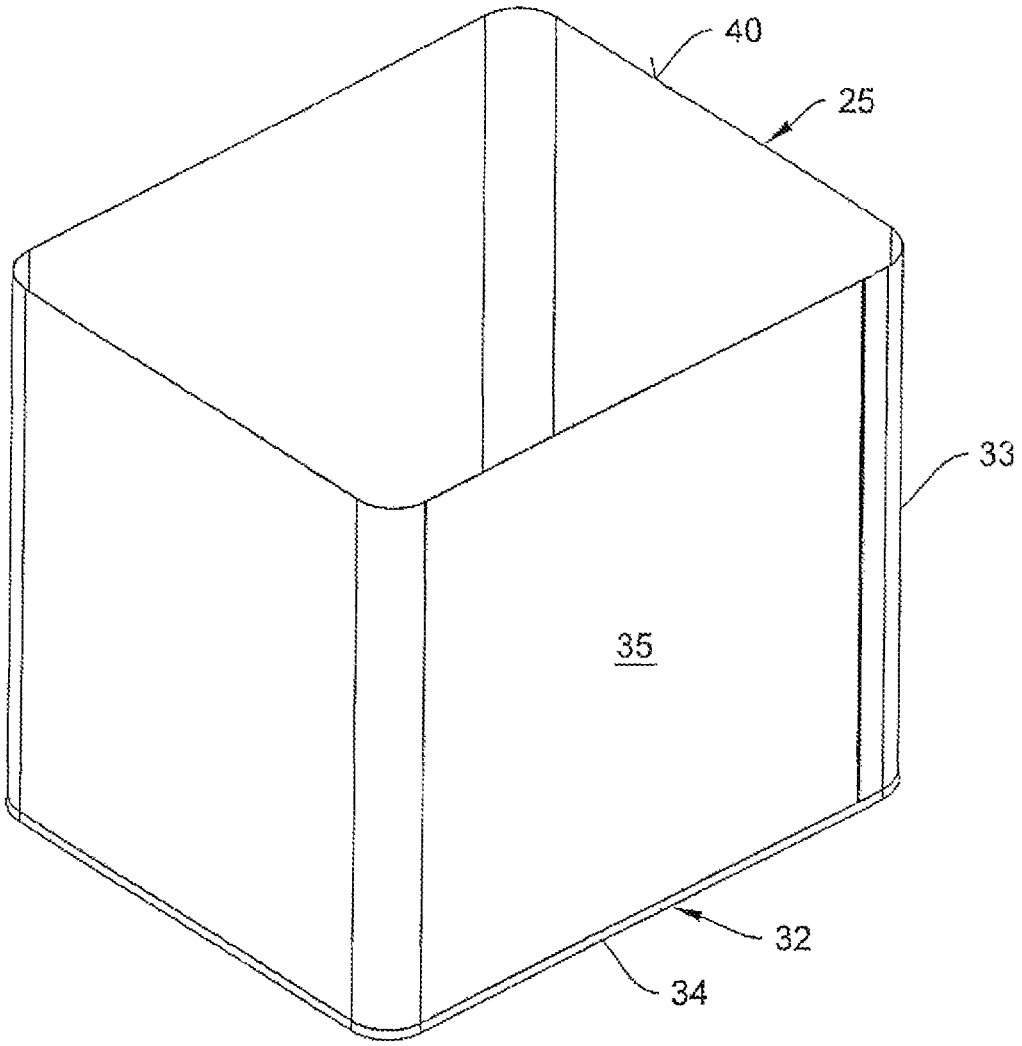
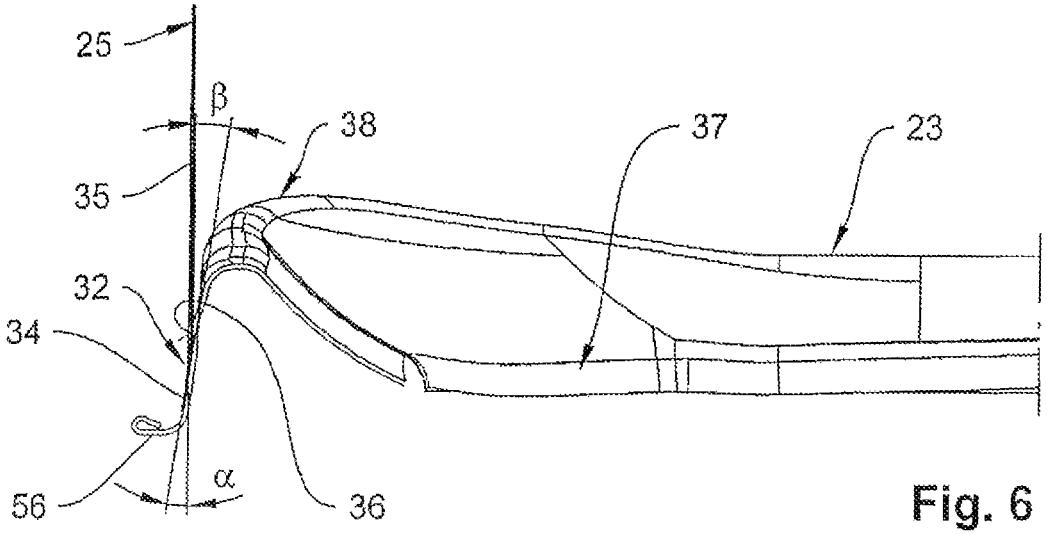
Fig. 6

TRANSPORTING AND STORAGE CONTAINER FOR LIQUIDS

BACKGROUND OF THE INVENTION

Field of the Invention

The invention at hand relates to a transportation and storage container for liquids having an inner container made of plastic, an outer jacket preferably realized as a lattice made of metal as well as a pallet-like base frame formed for being handled by means of forklifts or similar modes of transportation, and comprising a support base made of sheet metal for supporting the inner container provided with at least one filling neck at an upper side of the inner container.

SUMMARY OF THE INVENTION

The transportation and storage containers already known according to the type mentioned above are mainly used for transporting liquids, enabling storing the liquids in the same container after filling the liquids and transporting the liquids in the container within the scope of corresponding provisions in the sense of fire protection regulations. In the cases, when a particularly high flammability of the liquids stored in the container or when corresponding fire protection regulations at the storage location call for special precautionary measures for storing liquids, it is necessary to regularly refill the liquids into storage containers after transportation, which are equipped in a particular manner for reducing flammability. Such storage containers enable an increased fire resistance and thus a storing of the liquids in a manner which fulfills even the strictest fire protections regulations.

The object of the invention at hand is to propose a transportation and storage container which enables storing highly flammable liquids in the container after transporting them without making refilling the liquids in special storage containers necessary.

The object is attained by the invention at hand having the features of claim 1.

The transportation and storage container according to the invention comprises an intermediary container made of sheet metal and surrounding the inner container on all sides between the inner container and the outer jacket, said intermediary container comprising a jacket case, a container lid connected to the jacket case and a container bottom connected to the jacket case, the container bottom being formed by the support bottom of the base frame.

By arranging an intermediary container between the outer jacket and the inner container, the fire resistance of the container is increased regarding the fire load of the container defined by the flammable liquids stored in the container. Furthermore, the intermediary container prevents the flammable liquid from flowing out of the inner container into the surrounding environment of the transportation and storage container should the plastic inner container fail due to thermal overload.

By using the support bottom of the base frame as a container bottom of the intermediary container surrounding the inner container on all sides, the fire protection of the inner container or rather the flammable liquid stored inside is increased with only a comparatively minimal increase in the entire weight of the container.

The embodiment of the intermediary container having a container lid enables a conventional loading from the top of the transport and storage container having the inner container according to the invention, so that in order to be arranged in the intermediary container, the inner container is passed into the jacket case from the top and can be placed on the support bottom of the base frame, which simultaneously forms the container bottom of the intermediary container.

According to an advantageous embodiment of the transportation and storage container, the container lid comprises a lid cap for covering the filling neck of the inner container passed through a lid opening, so that filling or emptying the inner container already arranged in the intermediary container via the neck can be realized without having to remove the container lid.

It is particularly advantageous if the container lid is detachably connected to the jacket case of the intermediary container, since this enables removing the inner container from the intermediary container for cleaning the inner container or reconditioning the transportation and storage container, respectively.

For this purpose, the container lid is preferably connected to the jacket case via screw connections.

Even though it is generally possible to provide the inner container with only one neck at its upper side, which is suitable for filling as well as emptying the inner container, it has proven advantageous if the inner container comprises at least one discharge neck formed independently of the filling neck at the upper side of the container and the container lid comprises a receiving opening bounded by a locking edge for passing the discharge neck therethrough, the diameter D of the receiving opening being smaller than the outer diameter d of a locking collar formed at the discharge neck.

Due to this preferred embodiment, producing a joined connection between the inner container and the container lid of the intermediary container can be realized in such a manner that a locking connection is produced between the locking collar of the discharge neck and the locking edge of the inner container when passing the discharge neck through the receiving opening. Thus, the inner container and the container lid connected via the locking connection can be handled as a single mounting unit, passed through the jacket case and be placed on the support bottom of the frame base when mounting the transportation and storage container.

If the inner container comprises two discharge necks at its upper side, which are preferably arranged to both sides of the filling neck, and the container lid comprises two receiving openings allocated to the discharge necks, the container lid is not only connected to the inner container but is also defined in its relative arrangement by the two discharge necks inserted in corresponding receiving openings of the container lid, so that the container lid is automatically located in the position suitable for a subsequent connection of the container lid to the jacket case after inserting the inner container into the jacket case of the intermediary container.

A leak-proof connection, even under high thermic stress of the connection between the jacket case and the support bottom, is possible if the jacket case is materially bonded to the support bottom at its lower edge, formed as a connecting edge, for forming the intermediary container.

The materially bonded connection makes connecting elements formed independently from the jacket case and the support base and being susceptible to the possibility of component failure under thermal stress redundant. The materially bonded connection between the jacket case and support base can generally be realized by integrally forming the jacket case to the support bottom. Producing the jacket case independently from the support bottom having subsequently realized a materially bonded connection between the jacket case and the support bottom is made possible by the jacket case being connected to the support bottom at its connecting edge via a welded connection.

If the jacket case comprises a circumferentially formed welded shoulder outwardly offset at its connecting edge for forming the welded connection, said welded connection abutting to a rising outer wall flank of a bottom wall of the support bottom framing a support surface for supporting the inner container, a specifically formed welded connection area is formed between the connecting edge of the jacket case and the bottom wall of the support bottom, so that the welded seam can be realized with a quality required for a seal weld.

It is particularly advantageous if the welded seam is realized as a resistance welding, during the production of which the welding components, meaning the welded shoulder of the jacket case and the wall flank of the support bottom, are pressed against each other, so that on the one hand no additional welding material is required for realizing the welded connection and that a welded seam free of entrapped gas is possible as a prerequisite for a consistent welded connection under high temperature conditions on the other hand.

If the lid comprises a lid bottom having a circumferentially formed lid edge protruding downward over the upper side of the inner container and adjusted to the cross-sectional contour of a circumferential upper edge of the inner container in its cross-sectional contour at the transition from the upper side to a lateral wall of the inner container, the container lid enables a similarly effective lateral support of the inner container after being connected to the jacket case of the intermediary container in the area of the upper edge of the inner container, as it is carried out via the bottom wall of the support bottom along the circumferential lower edge of the inner container at the transition of the lateral walls of the inner container to the lower side of the inner container.

BRIEF DESCRIPTION OF THE DRAWINGS FIGURES

In the following, a preferred embodiment of the transportation and storage container is described by way of the drawings.

In the figures

FIG. 4 shows a jacket case for receiving an inner container of the transportation and storage container shown in FIG. 1;

FIG. 6 shows a partial view of the container pot shown in FIG. 5, cut along the line VI-VI;

DETAILED DESCRIPTION OF THE INVENTION

Figure 1:
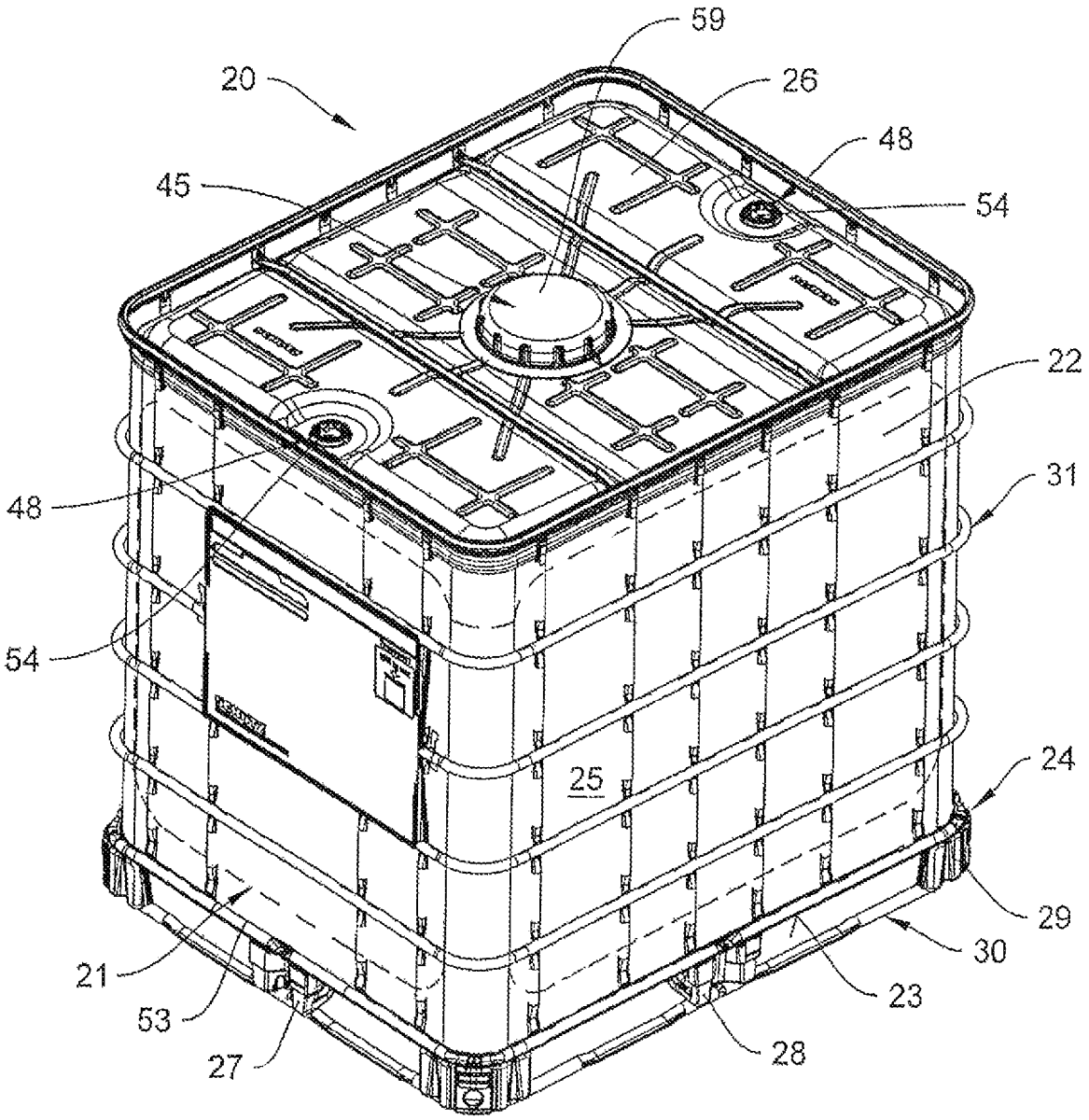
FIG. 1 shows an isometric view of the transportation and storage container.
Figure 2:
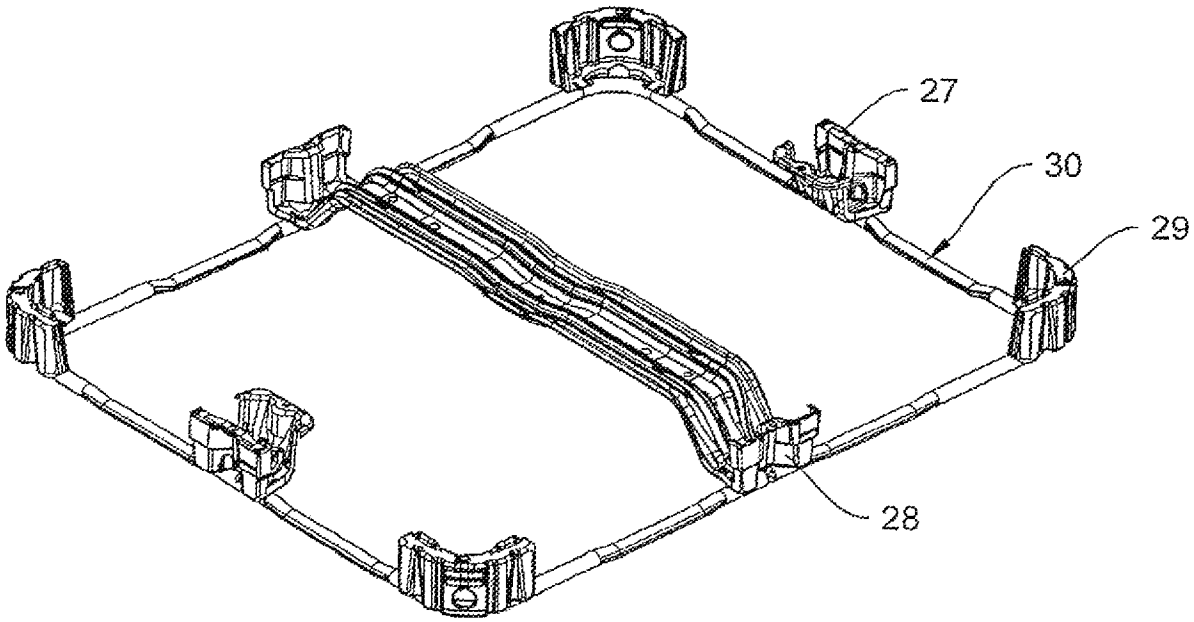
FIG. 2 shows a foot frame of a base frame of the transportation and storage container shown in FIG. 1.

FIG. 1 shows a transportation and storage container 20 having an inner container 22 shown in FIG. 1 having an interrupted line pattern arranged in an intermediary container 21.

Figure 3:
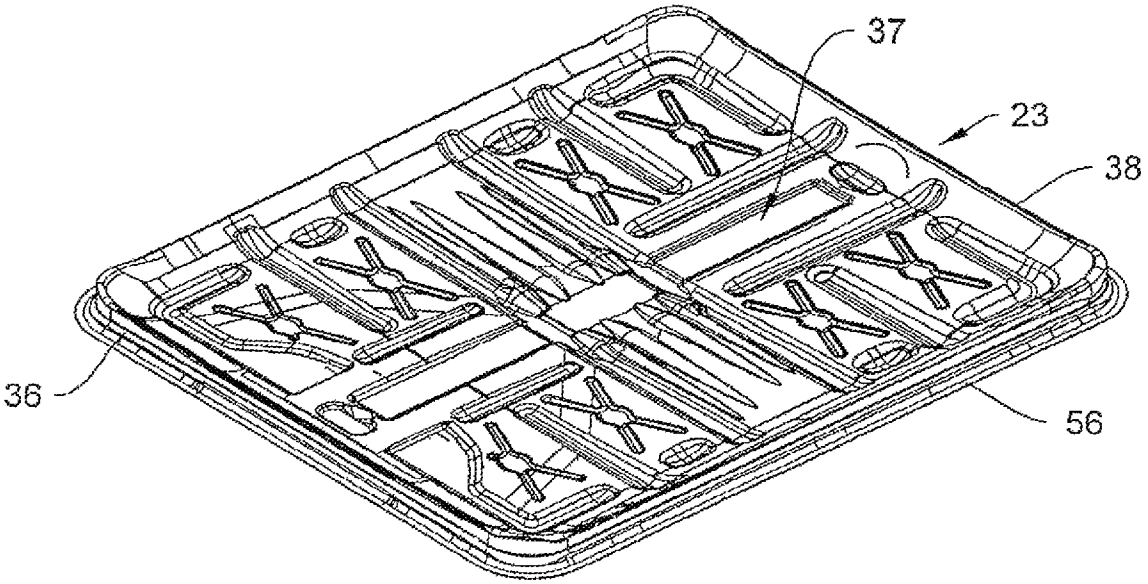
FIG. 3 shows a support bottom for arrangement on the foot frame shown in FIG. 2 and forming a pallet-like base frame.
Figure 9:
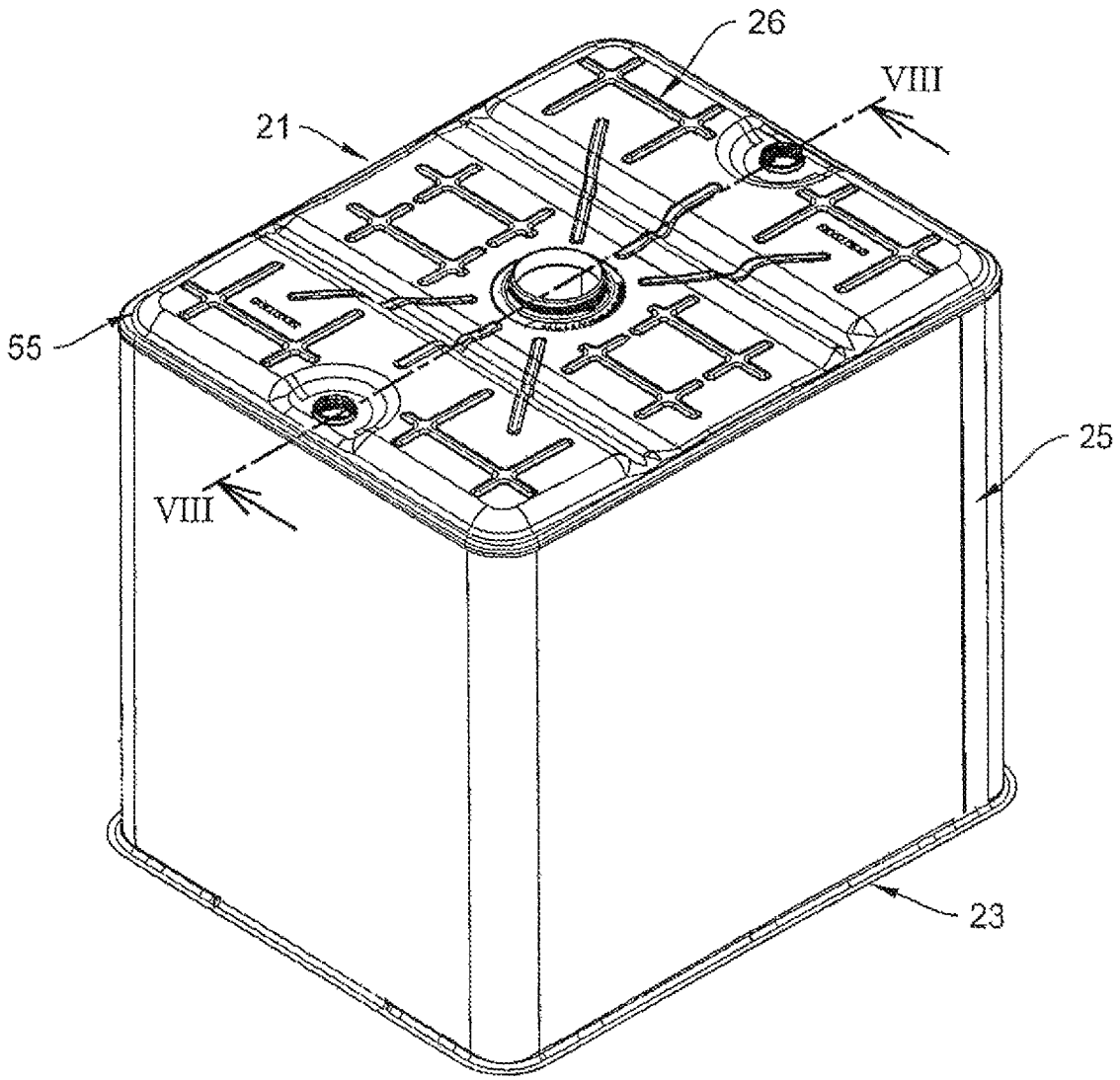
FIG. 9 shows the mounting unit inserted in the container pot for forming an intermediary container.

The intermediary container 21 shown in FIG. 1 is formed by a support bottom 23, also shown in a single view in FIG. 3, of a pallet-like base frame 24 of a jacket case 25, also shown in a single view in FIG. 4, and a container lid 26 arranged on the inner container 22 and is connected to the jacket case 25 just like the support bottom 23 (FIG. 9).

As can be seen in FIG. 1, the intermediary container 21 is arranged between the inner container 22 and a lattice-shaped outer jacket 31 of the transportation and storage container 20. The support bottom 23 is arranged on a plurality of middle feet 27, 28 and corner feet 29 for forming the base frame 24 formed as a frame pallet in the case at hand, the plurality of feet 27, 28, 29 being arranged on a common foot frame 30. The support bottom 23 forms the connection between the outer jacket 31 and the middle feet 27, 28 and corner feet 29 in such a manner that a horizontal frame pipe 53 arranged circumferentially at the lower edge of the outer jacket 31 is screwed to the middle feet 27, 28 and the corner feet 29 having the support bottom 23 arranged in between.

The support bottom 23 is therefore part of the intermediary container 21 as well as part of the pallet-like base frame 24.

Under reference to FIGS. 3 to 9, the production and the design of the intermediary container 21 is subsequently described further. Preferably, the jacket case 25 shown in FIG. 4 is produced starting from the cylinder jacket, which is reshaped into an angularly shaped jacket case 25 shown in FIG. 4 in a stretching procedure, the embodiment of the jacket case 25 being adjusted to the shape of the inner container 22, so that the jacket case 25 comprises adjusted reshaped edges 33 in particular at the vertical edges of the inner container.

In order to connect the jacket case 25 to the support bottom 23, the jacket case 25 is provided with a welded shoulder 34 offset downward shown in particular in FIG. 6 at a lower connecting edge 32 formed circumferentially. The welded shoulder 34 is inclined outward by an offset angle $\alpha$ with respect to lateral surfaces 35 of the jacket case 25, the offset angle $\alpha$ corresponding to a flank angle $\beta$, underneath which an outer wall flank 36 of a bottom wall 38 frames a support surface 37 (FIG. 3) of the support bottom 23 with respect to a vertical direction.

Figure 5:
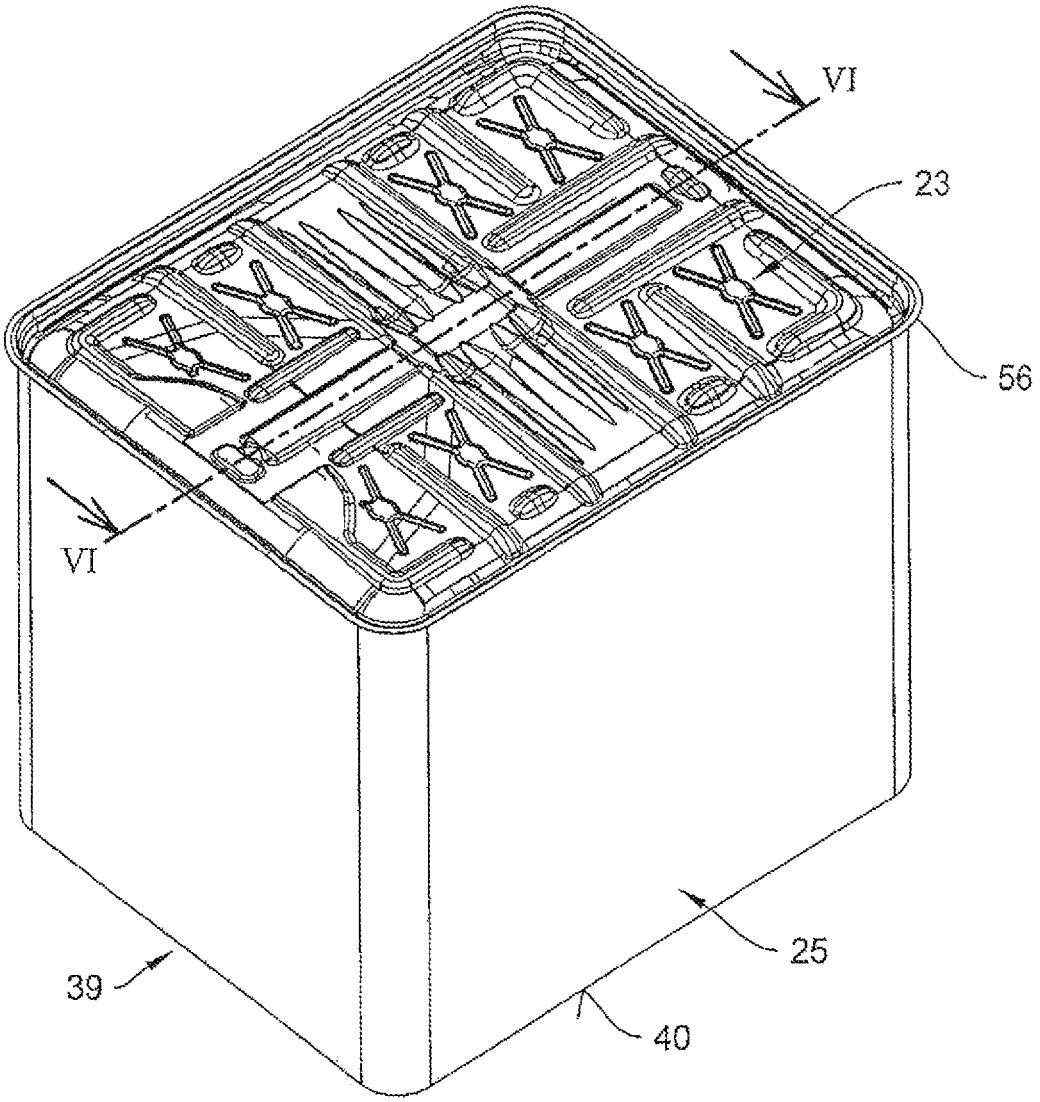
FIG. 5 shows the support shown in FIG. 3 in an arrangement materially bonded to the jacket case shown in FIG. 4 via a welded connection for forming the container pot.

As FIG. 6 shows, a welded contact area formed flat between the wall flank 36 and the welded shoulder 34 is realized due to the embodiment of the connecting edge 32 of the jacket case 25 described above, said welded contact area enabling a welding of the bottom wall 38 of the support bottom 23 to the connecting edge 32 of the jacket case 25. Preferably, the welding is carried out by means of a resistance welding, in which the wall flank 36 and the welded shoulder 34 are pressed against each other and welded in order to form a contact force, so that a container pot 39 shown in FIG. 5 is formed, which is subsequently provided with the container lid 26 for forming the intermediary container 21 shown in FIG. 1.

Figure 7:
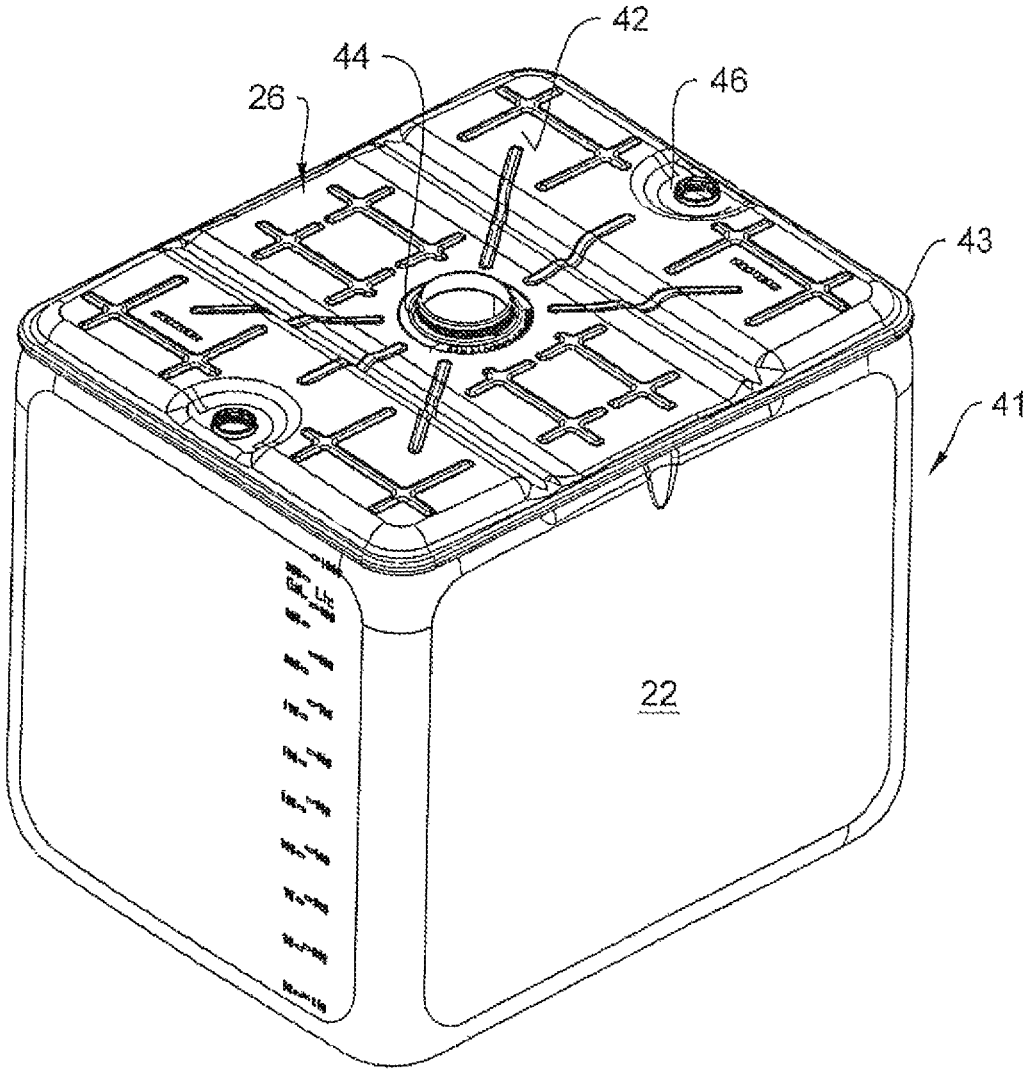
FIG. 7 shows a mounting unit formed by a container lid and the inner container.

Before the container lid 26 is arranged on an opening edge 40 defining a container opening of the container pot 39, the production of a mounting unit 41, shown in FIG. 7, formed by the container lid 26 and the inner container 22 is realized. As seen in FIG. 7, the container lid 26 comprises a lid bottom 42 having container edge 43 formed circumferentially. A lid opening 44, formed centrally in the lid bottom 42 here, for passing a filling neck 45 (FIGS. 1 and 11) therethrough as well as two receiving openings 46 each adjacent to the lid edge 43 are provided in the lid bottom 42, the lid opening 44 and receiving openings 46 each serving to receive an discharge neck 48 formed on an upper side 47 (FIG. 8) of the inner container 22.

Figure 11:
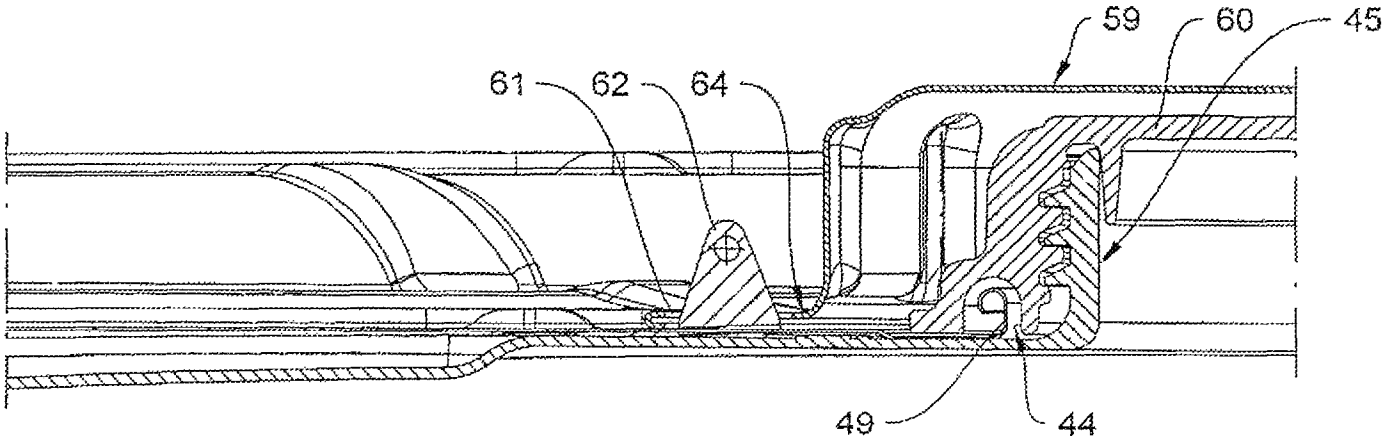
FIG. 11 shows an enlarged partial view of the container lid provided with a lid cap for covering a filling neck of the inner container.

As shown in FIG. 11, the lid opening 44 is formed for passing the filling neck 45 therethrough in such a manner that the filling neck 45 can be passed through the lid opening 44 without contacting the opening edge 49 of the lid opening 44. In comparison, the receiving openings 46 comprise a diameter D, as particularly shown in FIG. 8, which is smaller than the outer diameter d of the discharge neck 48 in such a manner that the discharge necks 48 have to be reshaped for passing through the receiving opening 46 when setting the container lid 26 on the upper side 47 of the inner container 22 in order to produce a contact between the lid bottom 42 and the upper side 47 of the inner container 22, so that a locking collar 50 formed at the discharge neck 48 locks behind a locking edge 51 bounded by the receiving opening 46 after having passed through the receiving opening 46.

In order to carry out the joining process described above, the discharge necks 48 can be retracted into the receiving openings 46 by means of a suitable claw tool, for example, which engages behind a lower edge 52 of the discharge neck 48 protruding into the inner container 22 by overcoming the deformation resistance of the discharge neck 48.

Figure 8:
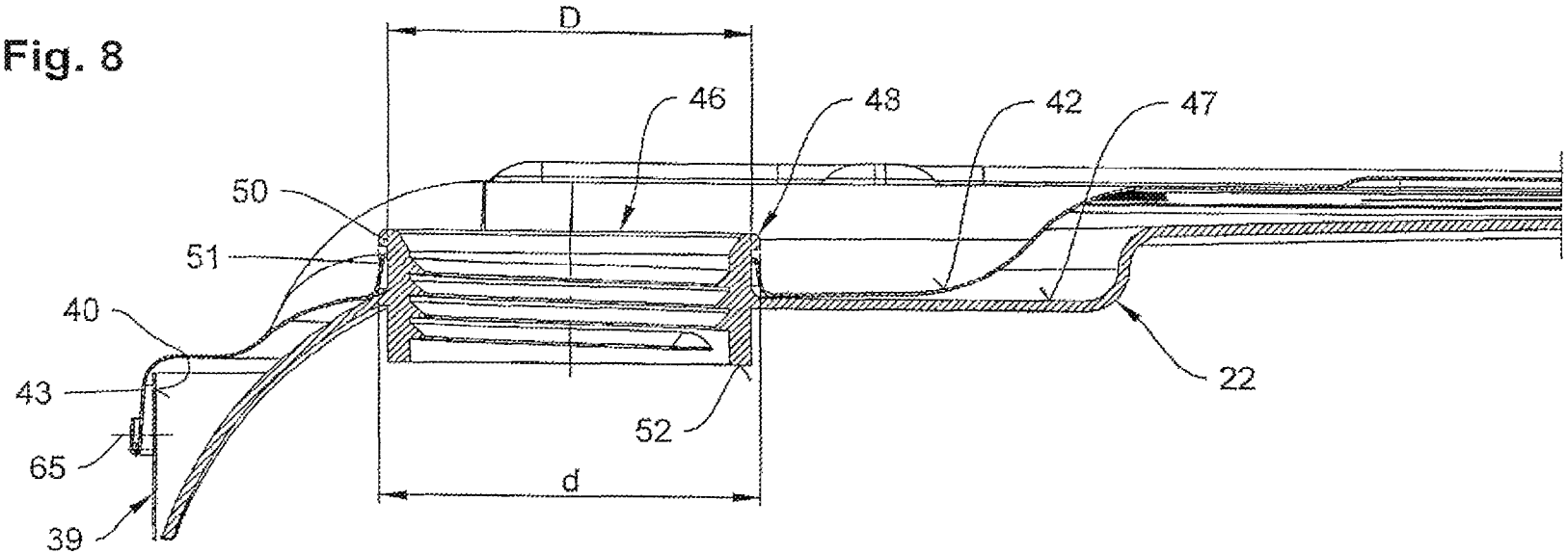
FIG. 8 shows a partial view of the mounting unit shown in FIG. 7, cut along the line VIII-VIII in FIG. 7.

The mounting unit 41 formed by the inner container 22 and the thereto connected container lid 26 shown in FIG. 7 can then be inserted into the container pot 39 from the top, so that the container edge 43, as shown in FIG. 8, abuts to the opening edge 40 of the container pot 39 and a connection, for example produced by a screw connection 65 of the container lid 26 to the container pot 39 and being preferably realized in corner areas 55 of the container lid 26, can be realized for producing an intermediary container 21 surrounding the inner container 22 on all sides shown in FIG. 9.

Figure 10:
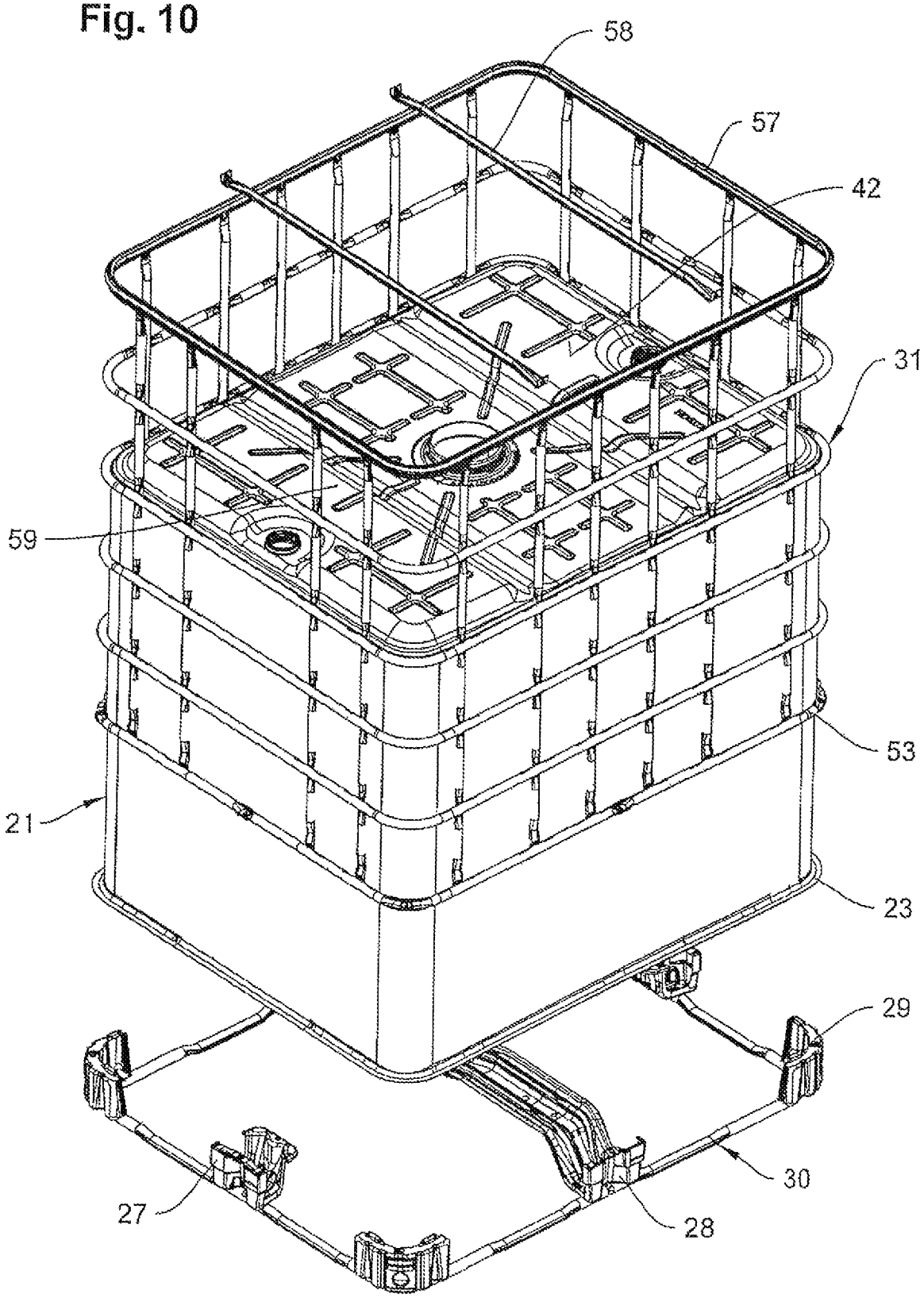
FIG. 10 shows a mounting method for forming the transportation and storage shown in FIG. 1.

As shown in FIG. 10, the transportation and storage container 20 shown in FIG. 1 is mounted by starting from the intermediary container 21 receiving the inner container 22 via subsequently connecting the support bottom 23 formed at the intermediary container 21 to the outer jacket 31 and the middle feet 27, 28 and the corner feet 30 arranged on the foot frame 30 in such a manner that the middle feet 27, 28 and the corner feet 29 are screwed to the lower horizontal frame pipe 53 of the outer jacket having a connecting edge 56 (FIG. 3) of the support bottom 23 arranged in between. Subsequently, in the case of the exemplary embodiment shown, a stiffening of the outer jacket 31 is realized at its upper horizontal frame pipe 57 via traverse rods 58 screwed to the frame pipe 57 and arranged in bead-shaped recesses 59 of the lid bottom 42.

As shown in FIG. 1, the filling necks 45 are provided with sealing plugs 54 which are covered by seal caps made of metal not further illustrated which are connected to the lid bottom 42, so that discharge necks 48 also provided with the sealing plugs 54 are provided with a protective covering.

As shown in FIG. 11, the filling neck 45 is covered by a lid cap 59 covering the lid opening 44, said lid cap 59 covering a screw cap 60 for directly sealing the filling neck 45 and comprising a flange edge 64 provided with openings 61 which enable the passing of fastening tabs 62 arranged on the lid bottom 42. The fastening tabs 64 are provided with passage openings 63 which enable mounting a safeguard against manipulation, for example.

The invention claimed is:

1. A transportation and storage container (20) for liquids having an inner container (22) made of plastic, an outer jacket (31) as well as a pallet-like base frame (24) formed for being handled by means of forklifts, and comprising a support base (23) made of sheet metal for supporting the inner container (22) provided with at least one filling neck (45) at an upper side (47) of the inner container (22), characterized in that an intermediary container (21) receiving the inner container from all sides and made of sheet metal is arranged between the inner container (22) and the outer jacket, said intermediary container (21) comprising a jacket case (25), a container lid (26) connected to the jacket case (25) and a container bottom connected to the jacket case (25), the container bottom being formed by the support base (23) of the base frame (24);

wherein the intermediary container (21) prevents a flammable liquid from flowing out of the inner container (22) into the surrounding environment of the transportation and storage container (20) should the plastic inner container (22) fail due to thermal overload; and the jacket case (25) is materially bonded to the support bottom (23) at the lower edge of the jacket case (25) formed as a connecting edge (32) so as to form the intermediary container (21).

2. The transportation and storage container according to claim 1, characterized in that the container lid (26) comprises a lid cap (59) for covering the filling neck (45) passed through a lid opening (44).

3. The transportation and storage container according to claim 1, characterized in that the container lid (26) is detachably connected to the jacket case (25) of the intermediary container (21).

4. The transportation and storage container according to claim 1, characterized in that the container lid (26) is connected to the jacket case (25) via screw connections (65).

5. The transportation and storage container according to claim 1, characterized in that the inner container (22) comprises at least one discharge neck (48) formed independently from the filling neck (45) at the upper side (47) of the inner container (22), and the container lid (26) comprises a receiving opening (46) bounded by a locking edge (51) for passing the discharge neck (48) therethrough, the diameter D of the receiving opening (46) being smaller than the outer diameter d of a locking collar (50) formed at the discharge neck.

6. The transportation and storage container according to claim 5, characterized in that the inner container (22) comprises two discharge necks (48) at its upper side (47) and the container lid (26) comprises two receiving openings (46) allocated to the discharge necks (48) for passing the discharge necks (48) therethrough.

7. The transportation and storage container according to claim 1, characterized in that the jacket case (25) is connected to the support bottom (23) at its connecting edge (32) via a welded connection.

8. The transportation and storage container according to claim 7, characterized in that the jacket case (25) comprises an outwardly offset welded shoulder (34) formed circumferentially at the connecting edge (32) of the jacket case (25) for forming the welded connection, said welded shoulder (34) abutting at a rising outer wall flank (36) of a bottom wall (38) of the support bottom (23), said bottom wall (38) framing a support surface (37) for supporting the inner container (22).

9. The transportation and storage container according to claim 8, characterized in that the welded connection is realized as a resistance welding.

10. The transportation and storage container according to claim 1, characterized in that the container lid (26) comprises a lid bottom (42) having a lid edge (43) formed circumferentially and protruding downward over the upper side (47) of the inner container (22), the cross-sectional contour of said lid edge (43) being adjusted to the cross-sectional contour of a circumferential upper edge of the inner container (22) at the transition from the upper side (47) to the lateral walls of the inner container.

11. The transportation and storage container according to claim 1, characterized in that the outer jacket is lattice-shaped.

12. The transportation and storage container according to claim 11, characterized in that the lattice-shaped outer jacket is made of metal.

* * * * *